US011708131B2

(12) United States Patent
Jackson et al.

(10) Patent No.: US 11,708,131 B2
(45) Date of Patent: Jul. 25, 2023

(54) MOORING LINE CONNECTOR ASSEMBLY AND TENSIONER

(71) Applicant: BALLTEC LIMITED, Morecambe (GB)

(72) Inventors: Jonathan Fletcher Jackson, Poulton-le-Flyde (GB); Marco Andre Teixeira, Lancaster (GB)

(73) Assignee: BALLTEC LIMITED, Morecambe (GB)

( * ) Notice: Subject to any disclaimer, the term of this patent is extended or adjusted under 35 U.S.C. 154(b) by 339 days.

(21) Appl. No.: 16/954,174

(22) PCT Filed: Dec. 13, 2018

(86) PCT No.: PCT/GB2018/053619
§ 371 (c)(1),
(2) Date: Jun. 15, 2020

(87) PCT Pub. No.: WO2019/116040
PCT Pub. Date: Jun. 20, 2019

(65) Prior Publication Data

US 2021/0155323 A1 May 27, 2021

(30) Foreign Application Priority Data

Dec. 15, 2017 (GB) ..... 1720991

(51) Int. Cl.
*B63B 21/50* (2006.01)
*B63B 22/18* (2006.01)
*B63B 21/00* (2006.01)

(52) U.S. Cl.
CPC ..... *B63B 21/502* (2013.01); *B63B 22/18* (2013.01); *B63B 2021/003* (2013.01); *B63B 2021/005* (2013.01); *B63B 2021/505* (2013.01)

(58) Field of Classification Search
CPC . B63B 21/18; B63B 21/502; B63B 2021/003; B63B 2021/505; B63B 2021/005
(Continued)

(56) References Cited

U.S. PATENT DOCUMENTS 5,244,313 A 9/1993 Pallini
9,181,761 B2 * 11/2015 Hafernik ..... E21B 19/002
2016/0214686 A1 7/2016 Kipp

FOREIGN PATENT DOCUMENTS

GB 2035240 A 6/1980
GB 2534595 A 8/2016
(Continued)

OTHER PUBLICATIONS

International Search Report and Written Opinion for PCT/GB2018/053619 dated Mar. 8, 2019; 12 pages.

*Primary Examiner* — Sunil Singh
(74) *Attorney, Agent, or Firm* — Schwabe, Williamson & Wyatt, PC

(57) ABSTRACT

A mooring line connector assembly (1) and a corresponding tensioner (28) are described. The mooring line connector assembly (1) comprises complementary male (2) and female (3) connectors, wherein the male connector (2) is rigid and the female connector (3) is connectable to the male connector (2) at a plurality of points along its length, so as to vary the tension applied to the mooring line. Locking balls engageable with grooves disposed along the length of the male connector (2) can allow the female connector to connect at different points along the male connector. A tensioner (28) allows the tension to be adjusted. The tensioner includes a first part (29) arranged to engage with the male connector (2) and a second part (29) arranged to engage with the female connector (3). The first part (29) reciprocates relative to the second part so as to move the male connector (2) relative to the female connector and
(Continued)

thereby change the point at which the female connector is connected to the male connector.

19 Claims, 10 Drawing Sheets

(58) Field of Classification Search
USPC ..... 405/223.1, 224, 224.4
See application file for complete search history.

(56) References Cited

FOREIGN PATENT DOCUMENTS

| | | | |
|---|---|---|---|
| WO | 2005/100696 | A2 | 10/2005 |
| WO | 2005/100697 | A2 | 10/2005 |

* cited by examiner

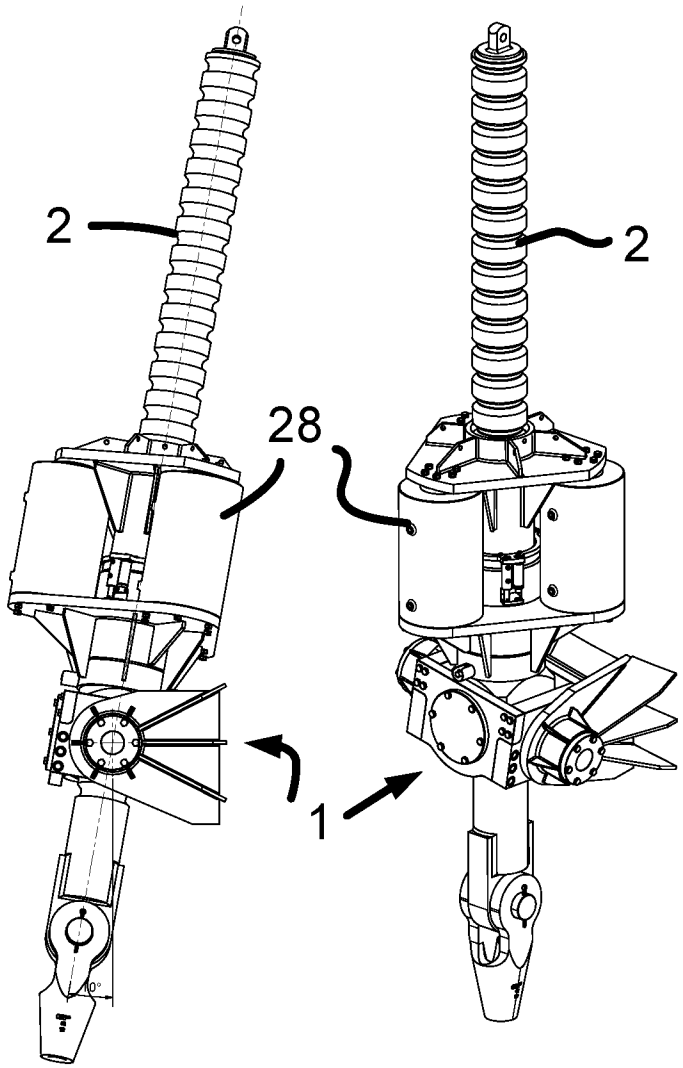
Figure 15D
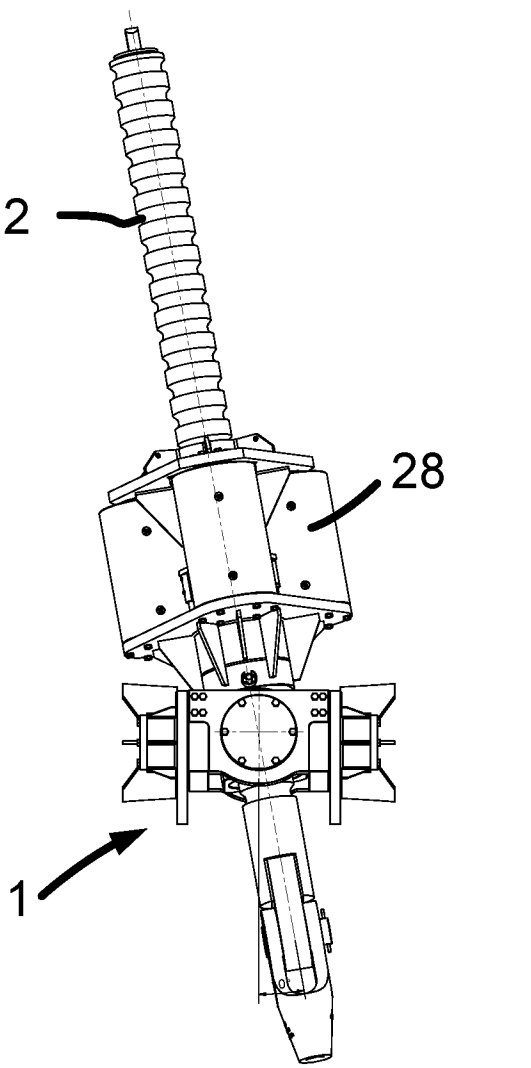
Figure 15C
Figure 15B
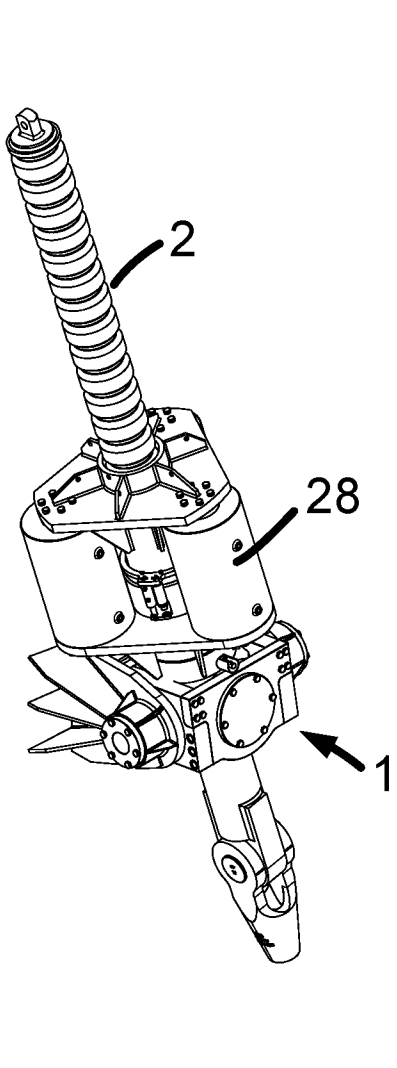
Figure 15A

MOORING LINE CONNECTOR ASSEMBLY AND TENSIONER

CROSS-REFERENCE TO RELATED APPLICATION

The present application is a national phase entry under 35 U.S.C. § 371 of International Application No. PCT/GB2018/053619, filed Dec. 13, 2018, which designates the United States of America, which claims priority to GB Application No. 1720991.7, filed Dec. 15, 2017, the entire disclosures of each of these applications are hereby incorporated by reference in their entireties and for all purposes.

TECHNICAL FIELD OF THE INVENTION

The present invention relates to a mooring line connector assembly and tensioner, especially a mooring line connector assembly and tensioner for connecting a mooring line to a tension leg platform (TLP) (including extended tension leg platforms (ETLPs)) or subsea production buoys. It is especially intended for the renewals market, e.g. connecting mooring lines to offshore wind turbines via TLPs at the surface, and to wave power generators at the surface or subsea.

BACKGROUND TO THE INVENTION

A tension-leg platform (TLP) is a vertically moored floating structure (or buoy) normally used for the offshore production of oil or gas, and is particularly suited for water depths greater than 300 metres and less than 1500 metres. Use of tension-leg platforms has also been proposed for wind turbines.

A subsea production buoy is a buoy which is tethered to the seabed such that it floats below the surface of the water. The principle use of subsea buoys is explained in WO2012/001406. As set out in that document, in deep water production fields, rather than installing a fixed production platform, it is common to anchor a floating production storage and offloading (FPSO) vessel at a suitable surface near the field and to make a connection between the pipeline on the seabed and the FPSO by a steel catenary riser (SCR) the SCR extends to a subsea buoy, which is tethered to the seabed. At the subsea buoy, the SCR is coupled to a flexible riser, and the flexible riser hangs between the FPSO and the subsea buoy.

Wave power generators may be moored subsea in the same manner as a subsea production buoy, or at the surface, in the same manner as a TLP.

As set out above, subsea buoys, and TLPs (whether supporting oil and gas production facilities or wind turbines) must be tethered to the seabed, as must wave power generators. The tethers used are typically composite fibre ropes. These ropes are very long and since they are so long, even a small difference in the amount of stretch per rope (which seems inevitable at present) can result in different lengths of tether once the ropes are under tension.

To ensure a stable and upright tethered structure despite differing lengths, tensioning systems are used. Typically, as discussed in WO2012/001406 these take the form of chain tensioning devices, normally supported on flexible joints. The end of each tether is connected to a chain, such that the amount of tension can be varied by pulling the chain through a ratchet mechanism, to engage different links in the chain.

These chains and chain tensioning devices are large, heavy and expensive to produce. They are somewhat difficult to manoeuvre, since they are flexible. Each link must be very large to withstand the forces applied to the chain, and the forgings for the chain tensioning devices are very large indeed. The tensioners (typically linear jacks formed of a pair of hydraulic pistons) need a long travel to pull the chain through the ratchet system by the length of at least one link at a time, so they too need to be large. And, to be stable despite the long travel, and frequently tensioning at an angle to the line, they need to be strong, which of course adds to the cost.

The present invention seeks to provide an improved mooring line connector assembly and a corresponding tensioner.

SUMMARY OF THE INVENTION

According to a first aspect of the present invention, there is provided a mooring line connector assembly, the mooring line connector assembly comprising complementary male and female connectors, wherein the male connector is rigid and the female connector is connectable to the male connector at a plurality of points along its length, so as to vary the tension applied to the mooring line.

This approach, whereby a rigid male connector can be connected to the female at a plurality of points along its length (i.e. whereby the relative position of the rigid male connector in the female connector can be varied), as opposed to an arrangement where the chain as a whole is flexible and each link can only be connected at one point, allows for in-line tensioning of the mooring line (because the rigid male connector can be pulled through the female connector in a straight line)—this is advantageous as it reduces the bending load on the components, allowing a less robust, and hence smaller, lighter and more manageable connector. The rigid member, which replaces the chain, can be made smaller, lighter and more cheaply and allows the tension to be resolved over a smaller distance, since the points along the length of the male connector where the female can be connected can be tailored as desired, unlike the resolution in the chain, which is defined by the size of each link (which in turn has a minimum length based on the thickness of the material of the link, which has a minimum thickness based on the load that will be applied).

The female connector may be connectable to the male connector at at least 5 different points along its length, so as to provide up to 5 variations in the tension applied to the mooring line; the female connector may be connectable to the male connector at at least 10 different points along its length, so as to provide up to 10 variations in the tension applied to the mooring line; the female connector may be connectable to the male connector at at least 20 different points along its length, so as to provide up to 20 variations in the tension applied to the mooring line; or the female connector may be connectable to the male connector at at least 25 different points along its length, so as to provide up to 25 variations in the tension applied to the mooring line.

The male connector may comprise a rigid bar, preferably a hollow bar, but optionally a solid bar. A solid bar can provide a greater ratio of tensile strength to width than a hollow bar, whereas a hollow bar can provide a greater circumference and better resistance to bending, for a given weight. The male connector may be at least 1 m, 3 m, 5 m or 7 m long. The male connector may be straight. The male connector may have a circular transverse cross section.

The male connector, in particular the rigid bar thereof, may be provided with a plurality of grooves or recesses along its length, for engagement with the female connector. The grooves may be circumferential grooves.

The grooves or recesses may be provided along at least 1 m, 3 m, 5 m or 7 m of the male connector. The grooves or recesses may have a longitudinal pitch of no more than 500 mm, no more than 300 mm, or no more than 250 mm, for example 220 mm. The pitch of the grooves or recesses defines the space between points along the length of the male connector at which it can be connected to the female connector and thus adjustment of the pitch allows for tailoring of the interval over which the tension can be resolved.

The female connector may comprise one or more locking members for connecting the female connector to the male connector. The locking members may be engageable with the grooves or recesses.

The one or more locking members may be moveable between engaged and disengaged positions (i.e. moveable relative to the body of the female connector). The one or more locking members may be biased towards the engaged position. In particular the locking members may be resiliently biased towards the engaged position.

The one or more locking members may comprise locking balls or rollers. The locking balls or rollers may be provided in one or more cage. The one or more cage may be biased (in particular resiliently biased) so as to bias the balls or rollers towards the engaged position. The cage may prevent the balls from falling out of the female connector.

The cage may comprise a coupler for coupling to a tensioner, such that the locking members can be held in the disengaged position (e.g. to allow the male connector to be disengaged). The coupler may take the form of a groove, bore or recess, for example a circumferential groove on its outer surface or one or more bores, e.g. teo diametrically opposed bores extending radially from its outside surface.

The locking members may be arranged circumferentially around a bore in the female connector, at least 2, 4, 6, 8, 10 or 12 locking members may be arranged in a ring shape.

Two or more rings of locking members may be provided. Where two or more rings are provided, their pitch may be equal to the pitch of the grooves or recesses (so as to engage at the same time), or may be different (e.g. half the pitch of the grooves or recesses), so as to be able to resolve the tension of on the mooring line over a shorter distance.

One or more biasing members may be provided to bias the locking members (optionally by biasing the cage). The biasing member may be a resilient biasing member; it may be a spring, such as a wire compression spring, or may be a gas strut or the like.

The locking members may be moveable along a ramp in the female connector between the disengaged position and the engaged position. The shape defined by the inner edges of the locking members may be smaller in the engaged position than the disengaged position. For example, in a female connector comprising a circular bore, with locking members arranged circumferentially around the bore, the locking members may be provided in a circular cage having apertures therein, through which the locking members may partially extend, and, the locking members may extend further radially inwardly in the engaged position than in the disengaged position, such that a polygon defined by joining the innermost edge each locking member in the engaged position is smaller than a polygon defined by joining the innermost edge each locking member in the disengaged position.

The female connector may comprise a first open end defining the entrance of a bore into which the male connector is inserted and an opposing second end, and the locking members may move between an engaged position closer to the first open end and a disengaged position closer to the second end. The cage, if present, may be biased (in particular resiliently biased) towards the first open end. The second end is preferably open, allowing the male connector to be pulled through from the first end to the second end.

This movement means that if the male connector is pulled towards the first open end (i.e. out of the entrance), and attempts to move the locking members, they are pulled into engagement, whereas, when the male connector is inserted, it can push the locking members towards the second end, moving them to the disengaged position (against the bias). Thus insertion is easy and when under tension, the male connector is not pulled out.

The second end of the female connector may be shaped for connection to a tensioner. Shaping the female connector to receive a tensioner allows for the tensioner to pull the male connector through the female connector in a straight line, even if the angle of the female connector to the structure is variable. The shaped second end may be frustoconical.

The coupler on the cage may be arranged at the second end of the female connector, optionally arranged to extend out of the second end of the female connector for engagement with the tensioner.

The female connector or, preferably, the male connector may be connectable to a tether. For this purpose, the male or female connector may comprise a terminal for connection to a tether, the terminal may comprise an aperture for receiving a clevis pin at the terminus of the tether, or a clevis for attachment to an aperture at the terminus of the tether.

In particular, male connector may comprise a terminal at one end for connection to the tether and a terminal at the opposite end for connection to a guide wire.

The female connector may be pivotally mountable to a structure, such as a TLP or subsea buoy).

The female connector may be pivotally mounted in a cradle. The mounting of the female connector in the cradle may allow it to pivot about an angle of at least 10 degrees, such as up to 20 degrees, or up to 30 degrees. This (relatively small) movement can be sufficient to bring the angle of the connectors in line with the mooring line, allowing the male connector to be pulled through the female connector in a straight line.

The cradle may be pivotally mountable to a structure (such as a TLP or subsea buoy), for example being pivotally mounted to a hang-off porch. The mounting of the cradle to the structure or hang-off porch may allow it to pivot about an angle of at least 10 degrees, such as up to 20 degrees, or up to 30 degrees. This (relatively small) movement can be sufficient to bring the angle of the connectors in line with the mooring line, allowing the male connector to be pulled through the female connector in a straight line.

The axis of rotation of the female connector relative to the cradle may be perpendicular to the axis of rotation of the cradle relative to the hang-off porch, or the structure it is mountable to.

This can allow pivoting about a range of directions replicating the function of a flexible joint, but incorporating it into the connector at a fraction of the price, and allowing the connection to occur in a straight line, as mentioned before.

According to a second aspect of the present invention there is provided a tensioner for adjusting the tension on a mooring line connector assembly according to the first aspect of the invention, optionally including any of the optional features, the mooring line connector assembly comprising complementary male and female connectors, wherein the male connector is rigid and the female connector is connectable to the male connector at a plurality of points along its length, so as to vary the tension applied to the mooring line; the tensioner having a first part arranged to engage with the male connector and a second part arranged to engage with the female connector and wherein the first part is reciprocally moveable relative to the second part so as to move the male connector relative to the female connector so as to change the point at which the female connector is connected to the male connector in order to vary the tension applied to the mooring line.

The tensioner may be shaped to be seated on the female connector, in particular the second part may be shaped to be seated on the female connector. In particular, where the female connector has a second end as set out above, the second part of the tensioner may be shaped to seat on the second end. The tensioner may be provided with a centring cone i.e. a frustoconical recess, to sit on a frustoconical portion of the female connector.

The tensioner may comprise a linear actuator for moving the first part relative to the second part so as to move the male connector relative to the female connector to change the point at which the female connector is connected to the male connector. The tensioner may comprise a plurality of linear actuators for the first part relative to the second part. The tensioner may comprise at least three linear actuators for moving the first part relative to the second part. The tensioner may comprise only three linear actuators for moving the first part relative to the second part. The or each linear actuator may be a hydraulic cylinder. The provision of three linear actuators improves stability compared to the conventional arrangement of just two hydraulic cylinders.

The or each linear actuator may have a stroke of no more than 1000 mm, no more than 600 mm, no more than 500 mm, no more than 300 mm, or no more than 250 mm, for example 220 mm. This is smaller than typical for the linear jacks used with a chain tensioner, but since the pitch of the grooves or recesses in the male connector are of this order, the stroke of the cylinder need be no greater in order to move the connection of the female connector from one groove to the next. Thus smaller, cheaper, hydraulic cylinders can be used without compromising strength.

The second part of the tensioner may comprise a coupler for coupling to the cage of the female connector such that the locking members of the female connector can be held in the disengaged position (e.g. to allow the male connector to be disengaged). The coupler on the tensioner may take the form of a hydraulically operated rod, or a plurality of such rods arranged to engage with a bore, groove or recess, for example a circumferential groove or bores on the outer surface of the cage.

The first part of the tensioner may comprise one or more locking members for engagement with the grooves or recesses of the male connector.

The one or more locking members of the tensioner may be moveable between engaged and disengaged positions. The one or more locking members may be biased, in particular resiliently biased, towards the engaged position.

The one or more locking members may comprise locking balls or rollers. The locking balls or rollers may be provided in one or more cage. The one or more cage may be biased, in particular resiliently biased, so as to bias the balls or rollers towards the engaged position. The cage may prevent the balls from falling out of the female connector.

The locking members may be arranged circumferentially around a bore in the first part of the tensioner. At least 2, 4, 6, 8, 10 or 12 locking members may be arranged in a ring shape. A plurality of rings, e.g. two rings may be provided spaced longitudinally along the first part of the tensioner and having the same pitch as the grooves or recesses in the male connector.

One or more biasing members (in particular resilient biasing members) may be provided to bias the locking members (optionally by biasing the cage). The biasing member may be a gas strut, such as a nitrogen spring, or a conventional wire spring, such as a compression spring or the like.

One or more release mechanisms may be provided to move the locking members to a disengaged position. The release mechanism may be a hydraulic cylinder, which may act upon the or each ball cage.

The locking members may be moveable along one or more ramps in the first part of the tensioner between the disengaged position and the engaged position. The shape defined by the inner edges of the locking members may be smaller in the engaged position than the disengaged position.

The tensioner may comprise a first open end defining the entrance of a bore into which the male connector is inserted and an opposing second end, and the locking members may move between an engaged position closer to the first open end and a disengaged position closer to the second end. The cage, if present, may be biased (in particular resiliently biased) towards the first open end. The second end is preferably open, to allow for a guide wire to be pulled through and because otherwise the bore would have to be very long to account for the length of the male connector.

This manner of movement of the locking members means that as the first part is moved away from the female connector (i.e. in a direction away from the entrance), the locking members are pulled into engagement, whereas, when first part is reciprocated back towards the female connector (once the female connector has engaged with the male connector to hold it in position), this will move the second end closer to the locking members, moving them to the disengaged position (against the bias). Thus there is no need to co-ordinate the grabbing and releasing of the male connector as the first part reciprocates relative to the second part.

The invention extends to a kit comprising a connector assembly according to the first aspect of the invention (optionally including any optional features) and a tensioner according to the second aspect of the invention (optionally including any optional features).

A third aspect of the present invention comprises a method of connecting a mooring line to a TLP (optionally supporting a wind turbine), a subsea buoy, a subsea wave power generator or a surface wave power generator, the method comprising providing the TLP (optionally supporting a wind turbine), subsea buoy, subsea wave power generator or surface wave power generator with a female connector of a mooring line connector assembly according to the first aspect of the invention (optionally including any optional features) and providing a mooring line connected to the male connector of a mooring line connector assembly according to the first aspect of the invention (optionally including any optional features), and introducing the male connector into the female connector.

The method may comprise adjusting the point at which the female connector is connected to the male so as to vary the tension applied to the mooring line.

The method may comprise using a tensioner according to the second aspect of the invention (optionally including any optional features) to increase the tension applied to the mooring line, by connecting the first part to the male connector, moving the first part away from the second part to pull the male connector through the female connector, until the female connector is connected to the male connector at a different point (e.g. until the locking members of the female connector engage with a different groove of the male connector). The method may then comprise disengaging the first part from the male connector and reciprocating the first part back towards the second part, then engaging the male connector once again and reciprocating the first part away from the second part, so as to move the male connector relative to the female connector so as to change the point at which the female connector is connected to the male connector in order to further increase the tension applied to the mooring line.

The method may comprise removing the tensioner once the desired tension has been reached.

The method may comprise moving the tensioner to another mooring line and carrying out the method set out above to tension that mooring line.

A fourth aspect of the invention comprises using a tensioner according to the second aspect of the invention comprising a coupler (and optionally including any optional features) to reduce the tension applied to a mooring line connected to a TLP (optionally supporting a wind turbine), a subsea buoy, a subsea wave power generator or a surface wave power generator with a connector according to the first aspect of the invention comprising locking members and a cage having a coupler (and optionally including any optional features); the method comprising seating the tensioner on the connector, engaging the first part with the male connector and the second part with the female connector, pulling the male connector through the female connector such that the female connector is disengaged from the male connector and coupling the couplers to hold the locking members of the female connector in the disengaged position, then allowing the male connector to become disengaged from the female connector.

DETAILED DESCRIPTION OF THE INVENTION

In order that the invention may be more clearly understood an embodiment thereof will now be described, by way of example only, with reference to the accompanying drawings, of which:

Figure 16:
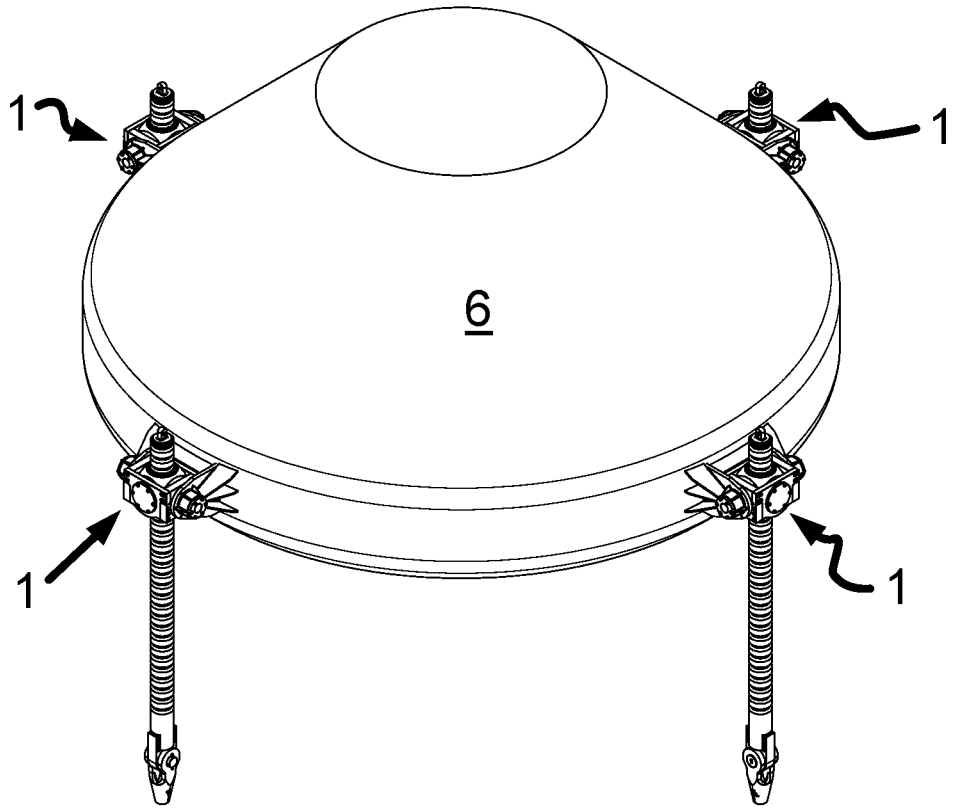
Figure 17:
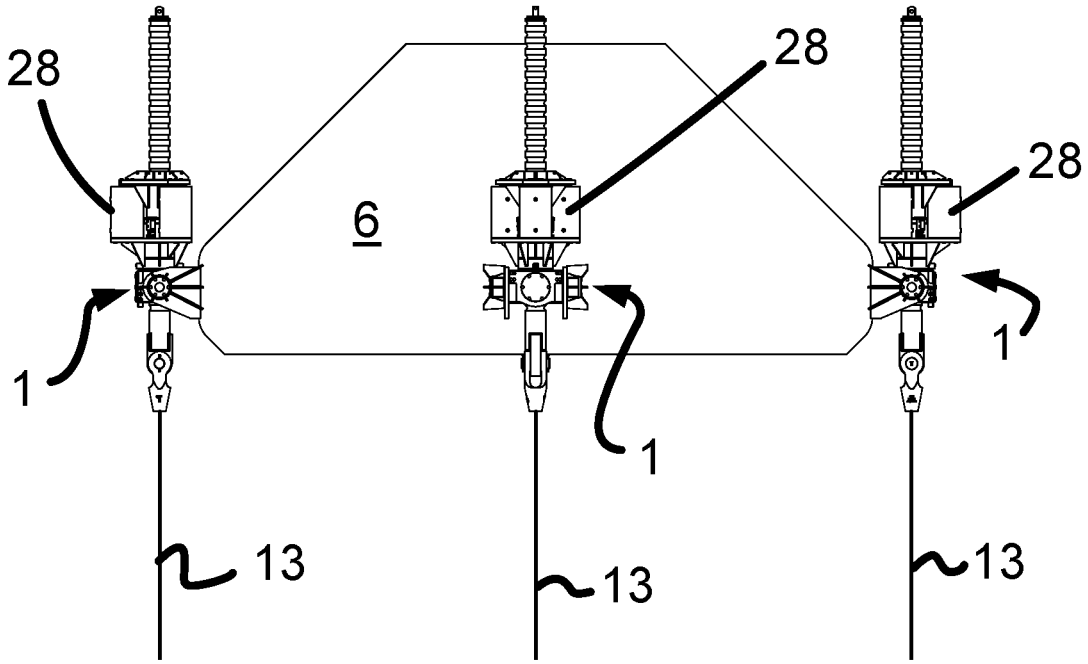

FIGS. 15A-D show perspective views of the mooring line connector assembly and tensioner with the male and female connectors at different angles with respect to the hang off porch;

FIG. 16 shows a perspective view of a subsea buoy with four mooring line connector assemblies of FIGS. 1 to 10 attached thereto; and FIG. 17 shows a side view of the subsea buoy and connector assemblies of FIG. 16 with a tensioner provided on each connector assembly, and with mooring lines connected to each male connector.

In the following description, terms such as upper and lower are used when referring to the connector assembly as shown in the drawings. It is to be understood that this is merely for convenience and ease of understanding. Of course, the connector assembly may be used in other orientations than that shown, in which case "upper" parts may be lower than their so-called "lower" counterparts.

Referring to the drawings, in particular FIGS. 1 to 7, a mooring line connector assembly 1 is shown. The connector assembly 1 comprises a male connector 2 and a female connector 3, the female connector 3 being pivotally mounted to a cradle 4 about one transverse axis (orthogonal to a bore through the female connector 3), and the cradle 4, in turn, being pivotally mounted about another transverse axis perpendicular to that by which the female connector 3 is connected to the cradle (and again orthogonal to the bore through the female connector 3) to a so-called hang-off porch 5. The hang-off porch is a bracket attached or attachable to a TLP (not shown), for example supporting a wind turbine (not shown), a subsea buoy 6 as shown in FIGS. 16 and 17, a subsea wave power generator (not shown) or a surface wave power generator (not shown).

Unless specified elsewhere, all the major components of the connector assembly 1 will be formed from suitable metallic materials, and formed by machining operations, easily determined by those skilled in the manufacture of subsea connectors.

The male connector 2 and the female connector 3 are complementary, with the female connector 3 (best seen in FIGS. 7 to 9) having a cylindrical bore 7 therethrough which is slightly wider than the outer diameter of a straight, rigid, hollow bar 8 of circular transverse cross section which forms the main constituent part of the male connector 2.

As best seen in FIGS. 1 to 4, the rigid bar of the male connector 2 is formed with a number of circumferential grooves 9 therein. To be precise, in this embodiment twenty-six circumferential grooves 9 are provided along the length of the bar 8.

The grooves 9 are provided along the majority of the length of the bar 8 and define different points at which the female connector 3 may be connected to the male connector 3 so as to vary the tension applied to the mooring line. In this particular example, the 26 grooves allow the female connector 3 to be connected at 25 different points along the male connector 2, so as to provide up to 25 variations in the tension applied to the mooring line.

The male connector 2 of this embodiment is just over 7 m long and has a diameter of about 40 cm. Each groove 9 is part-toroidal, and has a depth of about 5 cm and a length (along the length of the bar 8) of about 10 cm. The grooves 9 have a pitch of 22 cm from the start of one groove to the start of the next and are provided along about 5.5 m of the bar 8. At one end of the male connector 2, just above the first groove, a terminal 10 is provided with an eye 11 for receiving a guide wire (not shown) used to pull the male connector 2 through the female connector 3.

At the opposite end of the male connector 2, a part of the bar has a plain outer surface, with no grooves 9 (along about a tenth of its length), and at the end of this region a terminal 12 is provided for connection to a tether 13 (see FIG. 17). The terminal 12 (best seen in FIGS. 1 to 4) is provided with a joint 14 pivotable about one transverse axis orthogonal to the longitudinal axis of the male connector 2, and having a bore extending therethrough perpendicular to the transverse axis about which it pivots (and again orthogonal to the longitudinal axis of the male connector 2). The bore allows the terminal 15 of a tether to be connected to the joint 14 by means of a shackle formed in the terminal 15 of the tether and a corresponding bolt 16. The arrangement of the axes about which the joint 14 pivots and the axis of the bolt 16 about which the terminal 15 of the tether pivots allow the tether to extends in a straight line away from its terminal 15, avoiding stress from bending.

As mentioned above, each groove 9 in the male connector 2 represents a different point along the length of the male connector 2 where the female connector 3 may be connected to it (so as to vary the relative position of the male connector 2 and the female connector 3 and thereby vary the tension on the tether 13).

In order to connect to any of the grooves, the female connector 3 comprises locking members in the form of two circumferential rows of balls 17 for engagement with the grooves 9 and having the same pitch as the grooves 9. Hence, although there are twenty-six grooves, since the female connector 3 always connects to two adjacent grooves, only twenty-five variations in length are obtained.

Figure 1:
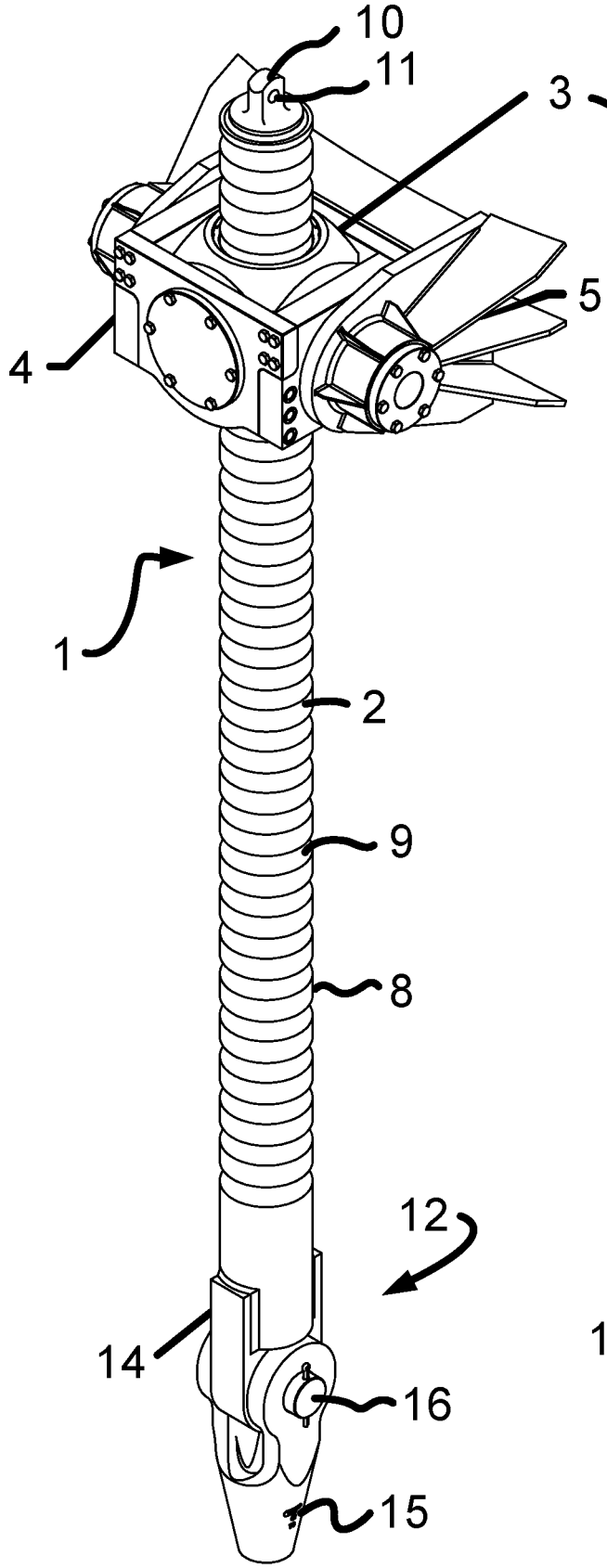
FIG. 1 shows an isometric view of a mooring line connector assembly.
Figure 2:
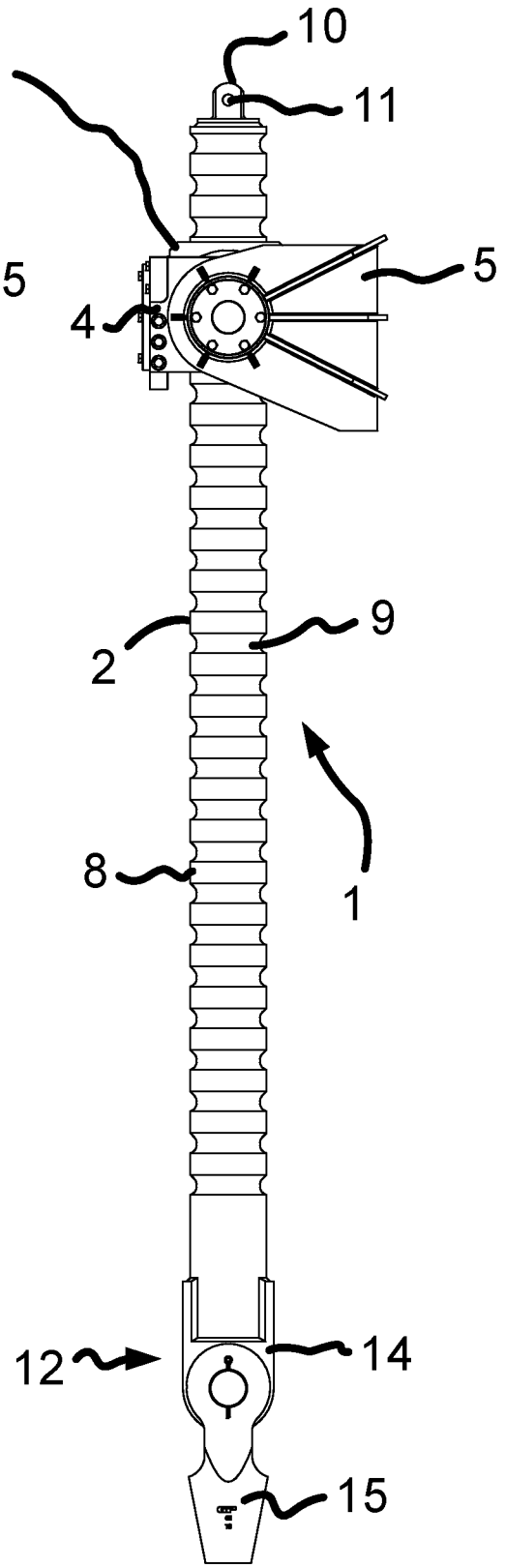
FIG. 2 shows a side view of the mooring line connector assembly of FIG. 1.
Figure 3:
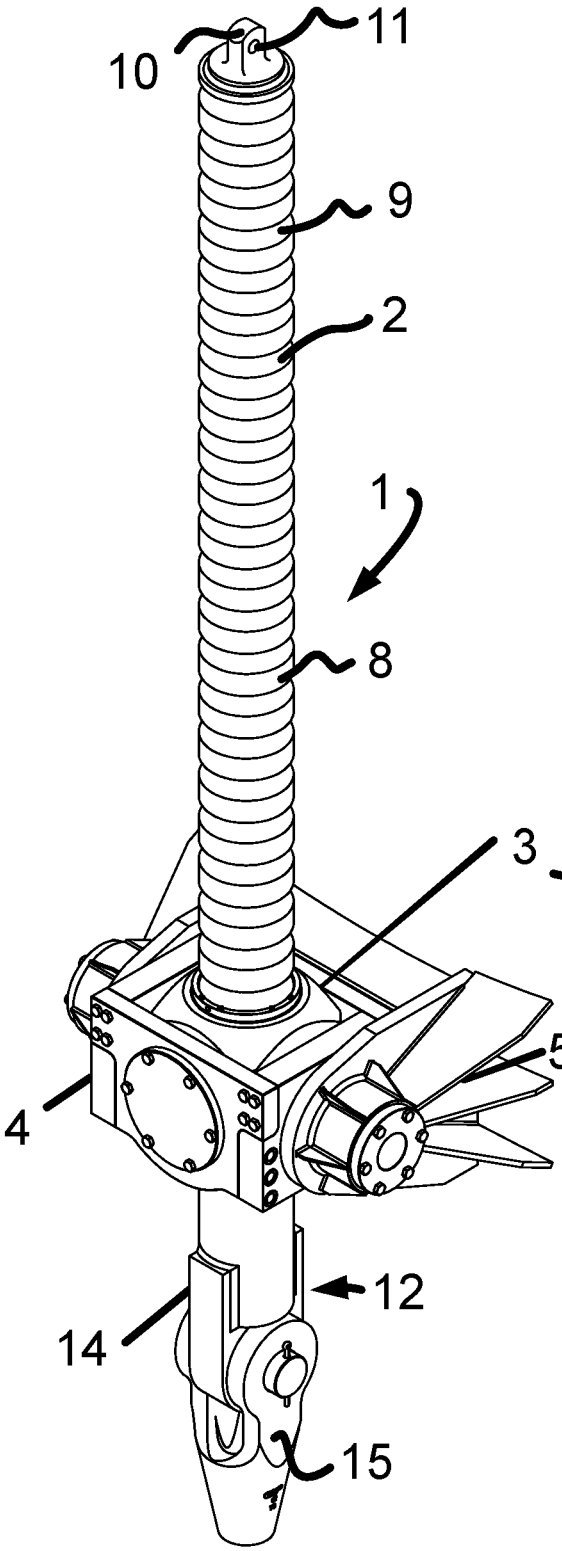
FIG. 3 shows an isometric view of the mooring line connector assembly of FIGS. 1 to 2 with the male connector in a different position.
Figure 4:
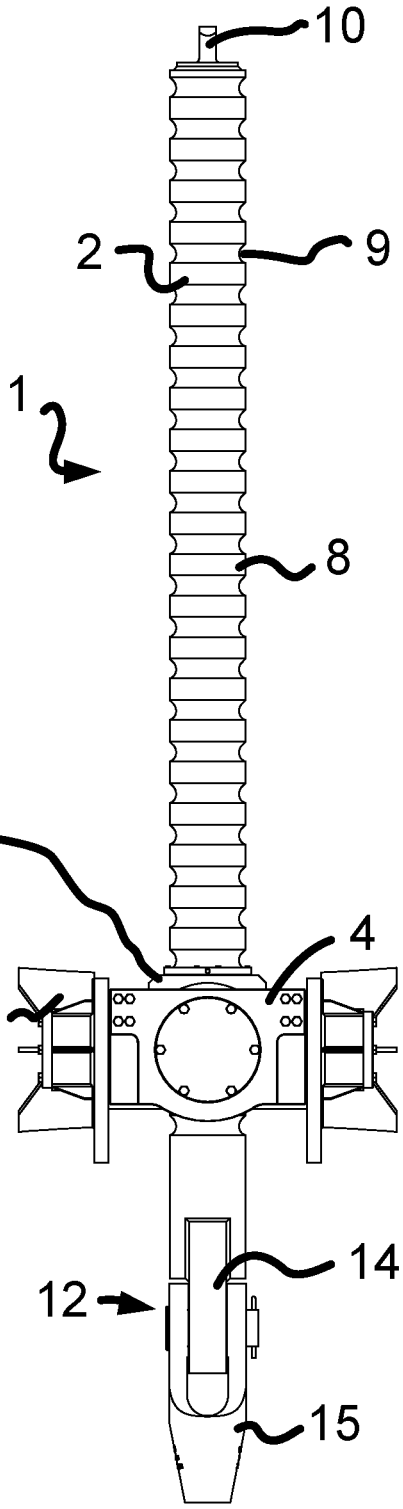
FIG. 4 shows a side view of the mooring line connector assembly of FIGS. 1 to 3, with the male connector in the position of FIG. 3 and looking perpendicular to the view of the mooring line connector assembly of FIG. 1.
Figure 5:
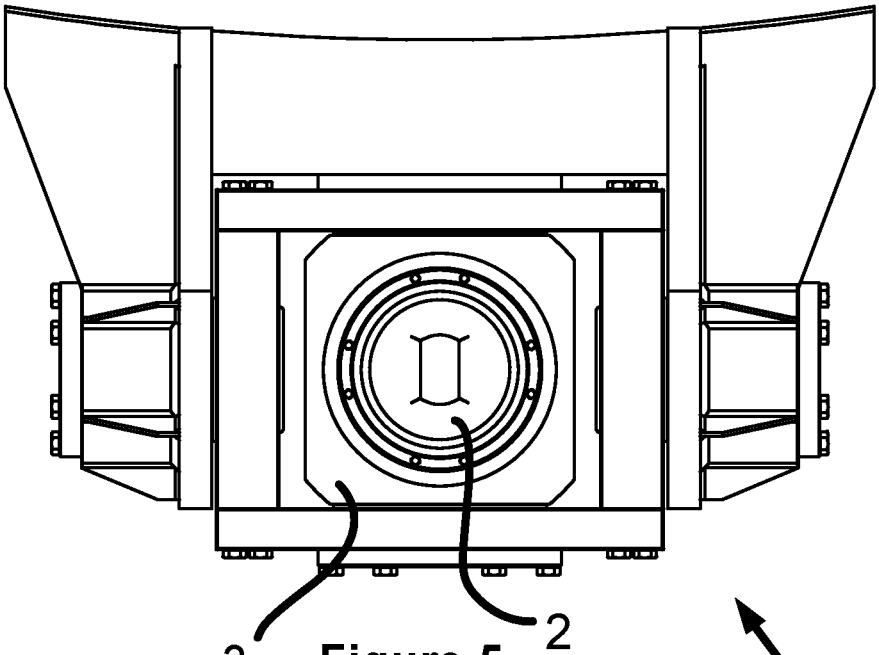
FIG. 5 shows a plan view of the mooring line connector assembly of FIGS. 1 to 4.
Figure 6:
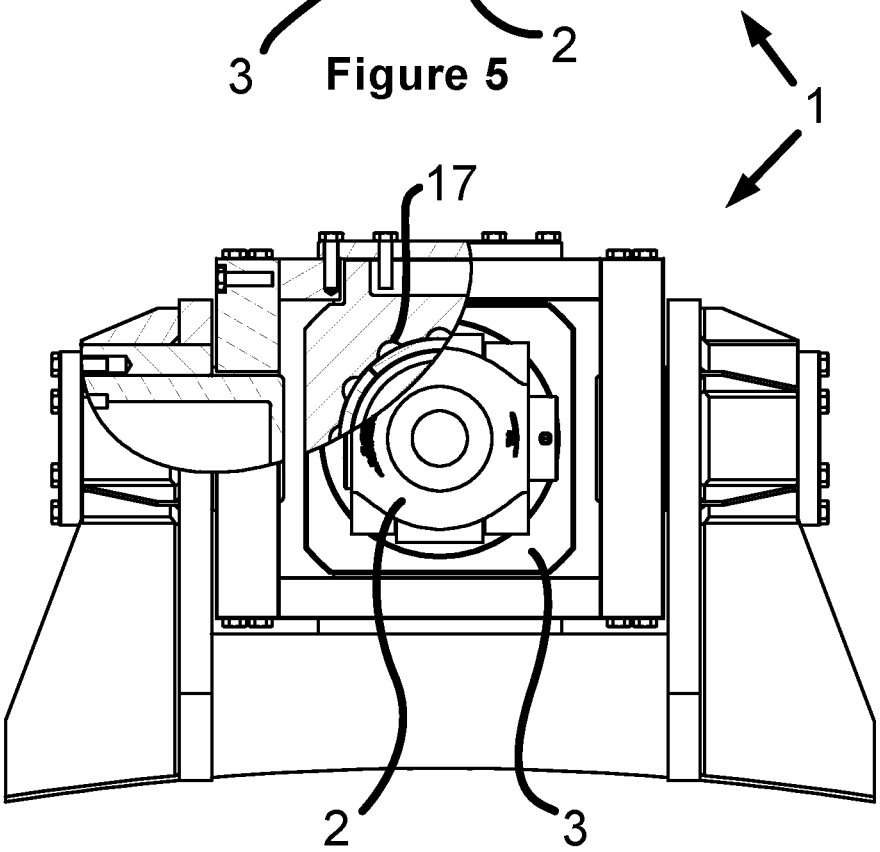
FIG. 6 shows an underneath view of the mooring connector assembly of FIGS. 1 to 5.
Figure 7:
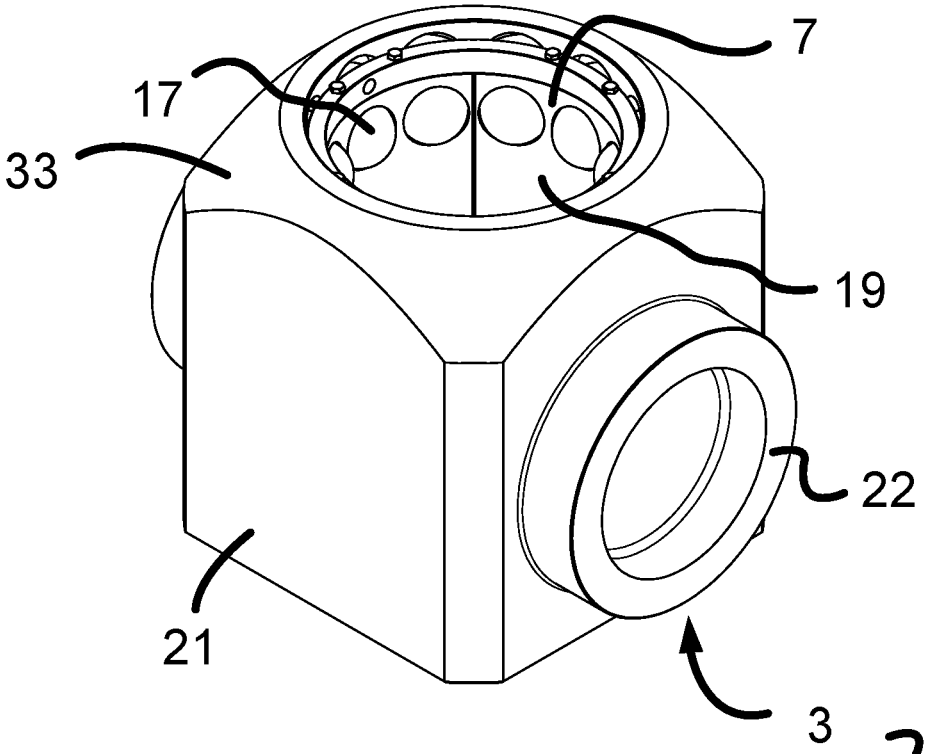
FIG. 7 shows a perspective view of the female connector of the mooring line connector assembly of FIGS. 1 to 6.
Figure 8:
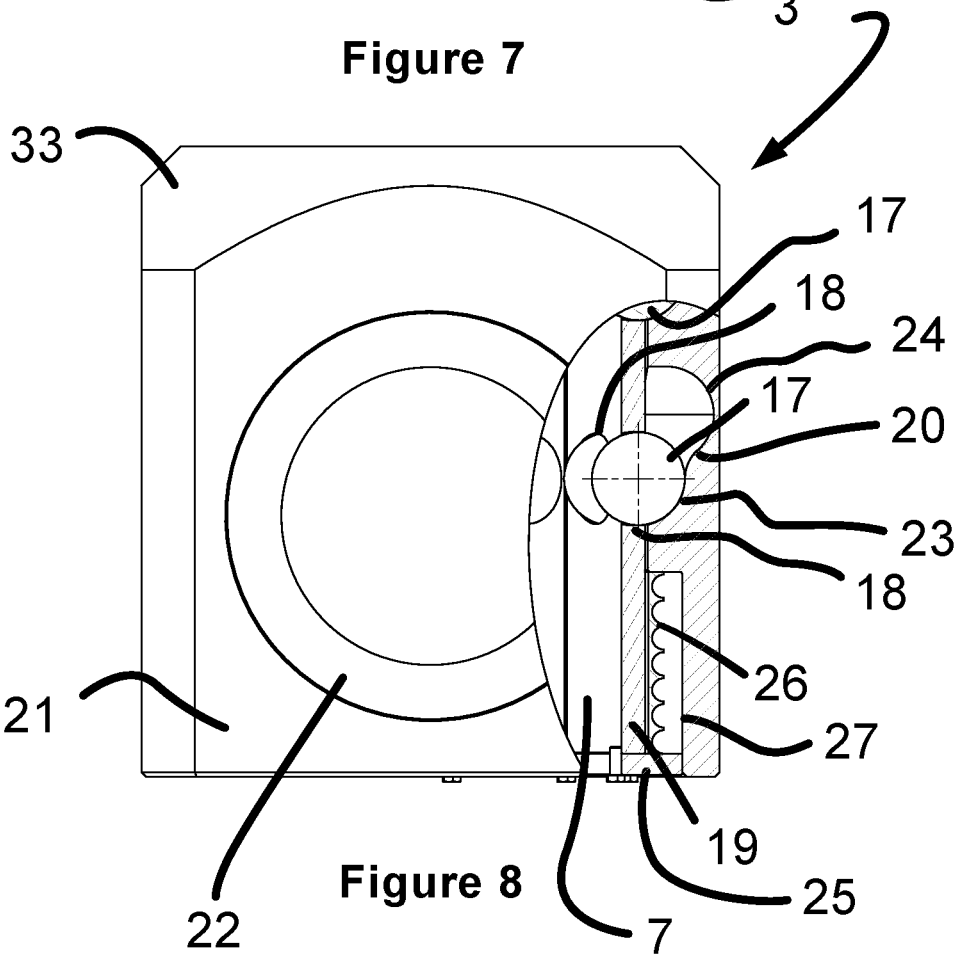
FIG. 8 shows a side view of the female connector of FIG. 7 in part cross-section.
Figure 9:
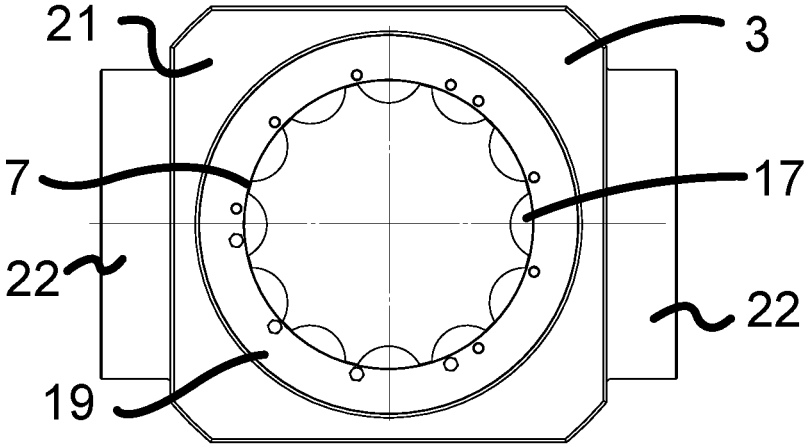
FIG. 9 shows a plan view of the female connector of FIGS. 7 and 8.
Figure 9A:
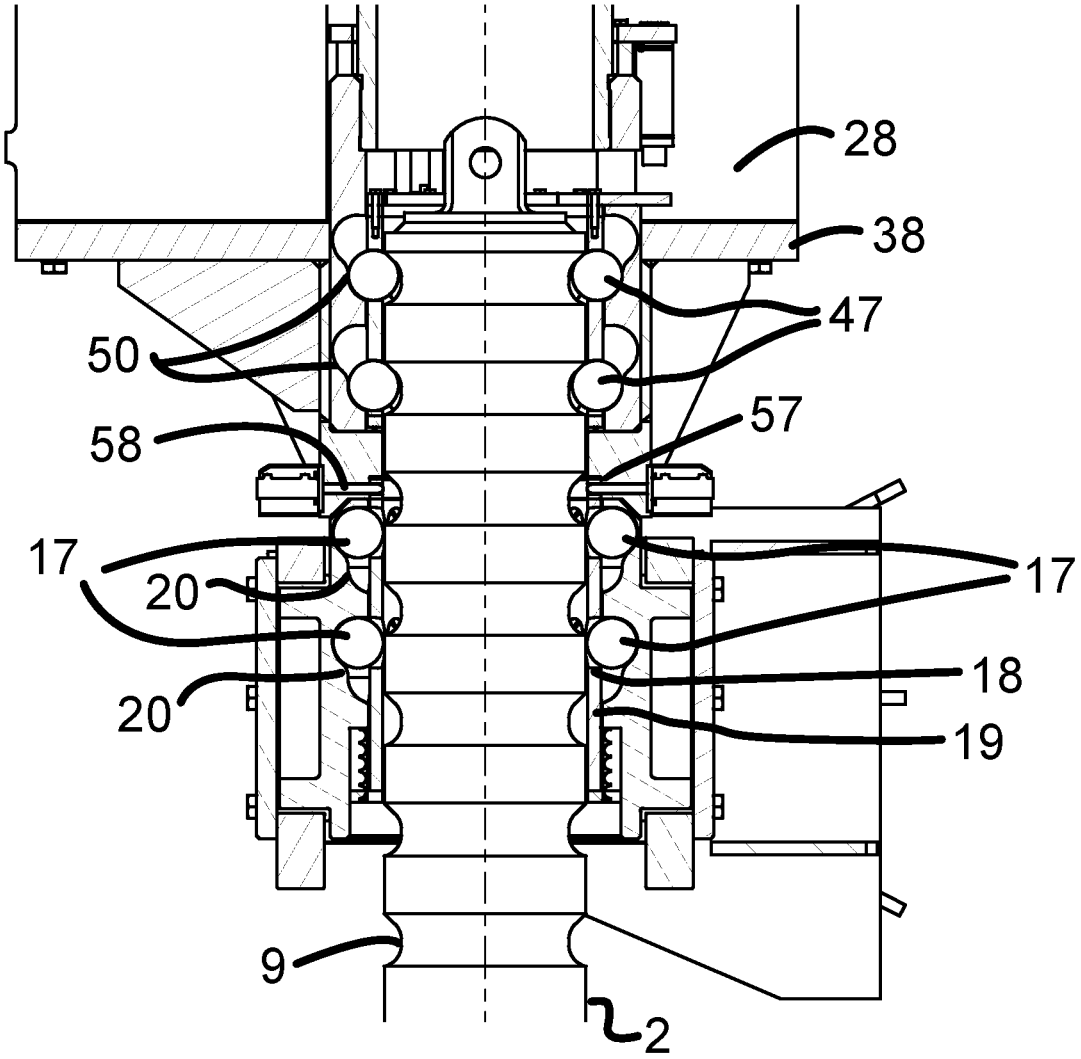
FIG. 9A shows a cross section through part of the mooring connector assembly of FIGS. 1 to 7 together with part of a tensioner.

The locking balls 17 are best seen in FIGS. 6 to 9A and as most easily understood from FIG. 8 (where one ball from a second row can be seen) they are moveable between an engaged position in which they are shown in FIG. 8 and a disengaged position shown in FIG. 9A.

In this particular example, twelve locking balls 17 are provided in each row, each set of twelve balls in a circumferential arrangement, capable of extending through apertures 18 extending through a tubular ball cage 19, the inner surface of which defines the bore 7 through the female connector 3. The apertures 18 in the ball cage 19 have a diameter at their inside edge of less than the diameter of the locking balls 17, so that the locking balls cannot fully escape from the cage 19, but only partially extend therethrough. The arrangement that provides for the movement of one row of balls 17 is described below. It is the same for the other row, so that is not described.

To cause the locking balls 17 to extend and retract through the inner edges of the apertures 18, they are seated on a ramped surface 20 in a body 21 of the female connector 3. It is this body 21 that is held in the cradle 4, and the body 21 has a generally cuboid outer shape, with a cylindrical bore running through it (in which the ramped surface 20 is formed and the cage 19 sits). To provide the pivoting motion, this outer cuboid shape has a pair of marine bearings 22 on opposing sides, which connect it to the cradle 4.

The ramped surface 20 forms a transition surface from a lower region 23 (of smaller diameter), where the locking balls 17 lie in the engaged position to an upper region 24 (of greater diameter) where the elements lie in a disengaged position. The upper region 24 takes the form of a depression shaped to the shape of the ball.

The ramped surface 20 is in the form of a shaped groove extending right round the circumference of the inside surface of the body 21, but it is conceivable that each ball could instead be provided with an individual groove extending longitudinally, with the same shape of ramped surface 20.

A radially outwardly extending flange 25 is provided at the bottom of the cage 19 forms the bottom of a pocket 27 at the bottom of the female body. A spring 26 (e.g. a wire compression spring) is provided in a pocket 27, biasing the ball cage 19 downwards and hence biasing the balls 17 up the ramped surface 20 towards the smaller diameter region where they are in the engaged position.

The shape of the lower region 23 of the ramped surface 20 combined with the size of the apertures 18 and the size of the balls 17 prevents the spring bias forcing the cage 19 out of the bottom of the female body 21.

As will be understood, the shape defined by the inner edges of the locking balls 17 is smaller in the engaged position than the disengaged position.

The inner edge of the inwardly extending flange 25 also defines a first open end of the female connector 3, being the opening to the bore 7 into which the male connector 2 is inserted. The top of the female body 21 is also open, defining a second open end in having an exit through which the male connector 2 extends.

The top of the cage 19 extends out of the second end of the female body 21 (the top as shown), when moved against the bias of the spring 26, and this upward movement moves the balls 17 in line with the deeper upper region 24 of the ramped surface 20 on which they sit. In consequence, the balls 17 can move into the disengaged position in this arrangement. In order that the cage 19 can be kept in this position with the balls 17 disengaged, it comprises a pair of couplers 57 for coupling to a tensioner 28 (described below), such that the locking members can be held in the disengaged position (e.g. to allow the male connector 2 to be disengaged). The couplers 57 shown in FIG. 9A take the form of a pair of diametrically opposed bores through the outer surface of the ball cage 19.

The top (or "second end") of the generally cuboid body 21 of the female connector 3 is provided with a generally frustoconical surface 33, the surface having an angle of 90 degrees to the (parallel) sides this acts as a centering mechanism for connection to the tensioner 28 described below, such that the tensioner 28 can be accurately seated with its centre over the centreline of the bore 7 through the female coupler.

The tensioner 28 is shown in place in FIGS. 9A, 10, 15 and 17 and alone in FIGS. 11 to 14. The tensioner 28 is formed in two parts which are reciprocally moveable with respect to one another; a first part 29 and a second part 30. The second part 30 of the tensioner 28 has a bevelled surface 31 at the base of a collar 32, so as to match the frustoconical surface 33 on the body 21 of the female connector 3. Thus, when the collar 32 is placed on and thereby engaged with the female connector 3, the bevelled surfaces acts as a centering cone, ensuring that its axis is coaxial with the bore 7.

Figure 13:
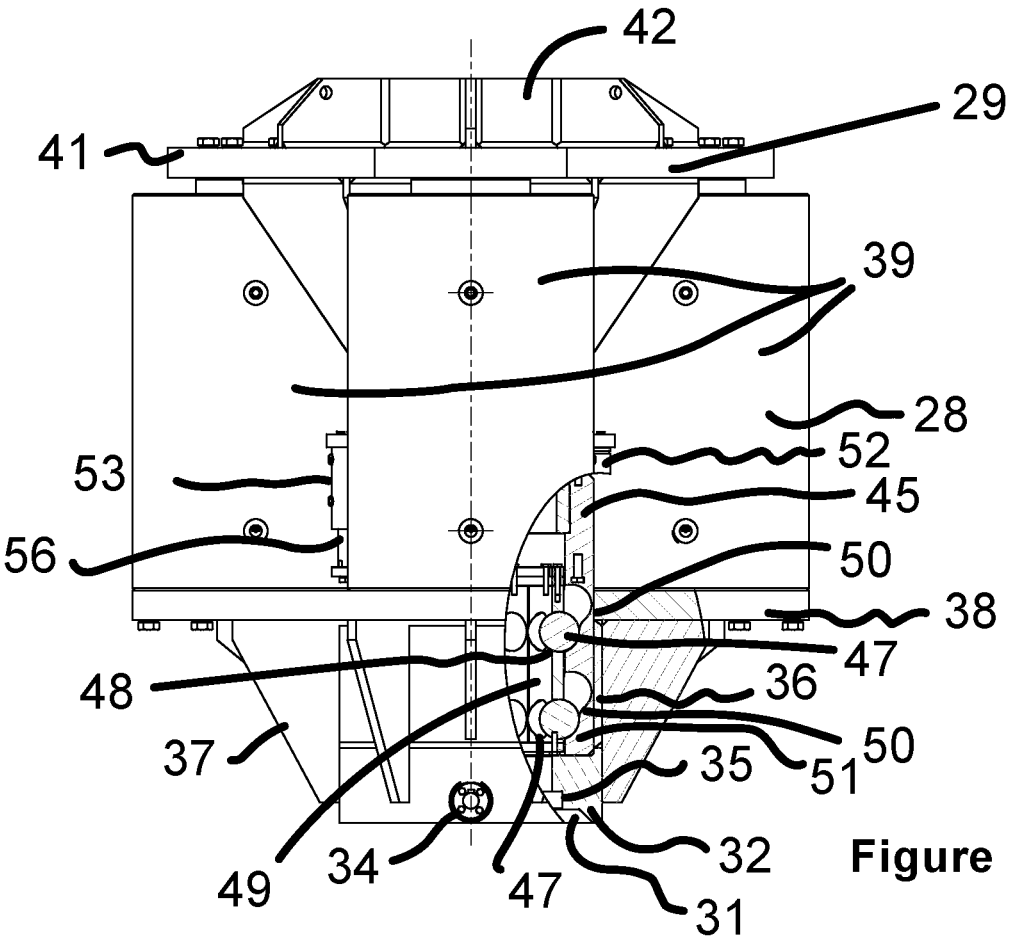
FIG. 13 shows a side view of the tensioner of FIGS. 10 to 12 in a rest position.

Near the base of the collar 32, a pair of diametrically opposing couplers 34 are provided. The couplers 34 are hydraulically operated rods 58, which extend into the aperture through the collar, just above the bevelled surface, so as to engage with the couplers 57 through the outer surface of the ball cage 19 mentioned above, and hold the locking members 17 in the disengaged position when necessary, as shown in FIG. 9A. As shown in FIG. 13, the collar 32 has a rebate 35, into which the ball cage 19 can be pulled. Above the collar 32, connected thereto by a tube 36 (coaxial with the collar and with the same outer diameter) and braces 37, is a generally triangular base plate 38. The generally triangular base plate 38 has a central hole of the same inner diameter as the tube 36, which is wider than that of the collar 32.

Towards each apex of the base plate 38, a hydraulic cylinder 39 is mounted; thus three hydraulic cylinders 39 are provided spaced equidistantly around the axis of the second part 30 of the tensioner 28, which is defined by the centreline through the collar 32, the tube 36 and the hole in the base plate 38. Each hydraulic cylinder 39 has a rod 40, which is arranged for reciprocal movement back and forth in the direction along which the centreline extends (up as shown in in phantom lines in FIG. 10 and in FIGS. 11 and 12 and down as shown in FIG. 13). Suitable hydraulic cylinders are available with a maximum stroke of 600 mm, which can together provide a tensioning force of 10,000 kN and provide a tensioning speed of 300 mm/min at 10,000 kN and 450 mm/min at 5,000 kN. The cylinders can be powered and controlled by umbilicals (not shown) from a surface vessel.

Each rod 40 is connected to the first part 29, so as to move the first part 29 back and forth with respect to the second part 30. In particular, each rod 40 is connected towards an apex of a generally triangular a top plate 41, which also has a central hole coaxial with the hole of the base plate, and surrounded by a guide collar 42 at the top of the top plate 41. Braces 43 surround the collar 42 to provide support. Each brace 43 includes a lifting hole 44 so that the tensioner 28 can be moved into position on the connector assembly 1.

The first part 29 is arranged to engage with the male connector 2, such that when it is reciprocated back and forth with respect to the second part 30, it can move the male connector 2 relative to the female connector 3 so as to change the point at which the female connector 3 is connected to the male connector 2 in order to vary the tension applied to the mooring line 13.

Accordingly, to allow connection of the first part 29 to the male connector 2, it is provided with a similar connection arrangement to that of the female connector 3. This connection arrangement is provided in a tubular connection part 45, which is suspended from the top plate 41 by a tubular support 46 (connected thereto by braces 4) and arranged to sit adjacent to (and coaxial with) the collar 32 of the second part 30, when the rods 40 are withdrawn into the hydraulic cylinders 39 and to move longitudinally away from the collar 32 when the rods 40 are extended.

Like the female connector 3, the tubular connection part 45 comprises locking members in the form of two circumferential rows of balls 47 for engagement with the grooves 9 and having the same pitch as the grooves 9.

Figure 14:
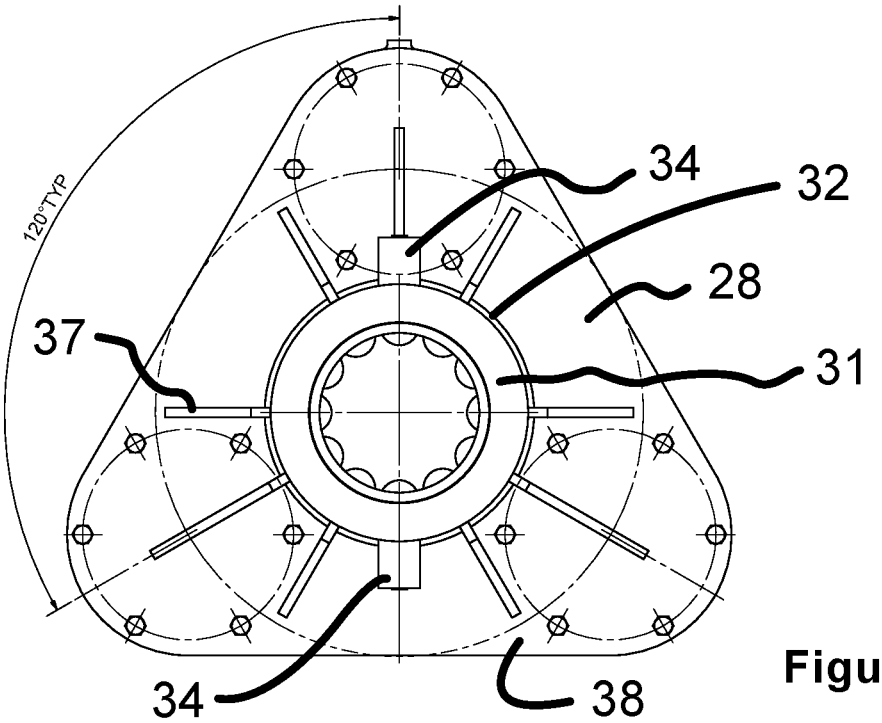
FIG. 14 shows a plan view of the tensioner of FIGS. 10 to 13.

The locking balls 47 can be seen in FIGS. 13 and 14 and they are moveable between an engaged position in which they are shown and a disengaged position.

Again, in this particular example, twelve locking balls 47 are provided in each row, each set of twelve balls in a circumferential arrangement, capable of extending through apertures 48 extending through a tubular ball cage 49. The apertures 48 in the ball cage 49 have a diameter at their inside edge of less than the diameter of the locking balls 47, so that the locking balls cannot fully escape from the cage 49, but only partially extend therethrough.

To cause the locking balls 47 to extend and retract through the inner edges of the apertures 48, they are seated on a ramped surface 50 in a body 51.

The ramped surface 50 forms a transition surface from a lower region (of smaller diameter), where the locking balls 47 lie in the engaged position to an upper region (of greater diameter) where the elements lie in a disengaged position. The upper region takes the form of a depression shaped to the shape of the ball.

The ramped surface 50 is again in the form of a shaped groove extending right round the circumference of the inside surface of the body 51, but it is conceivable that each ball could instead be provided with an individual groove extending longitudinally, with the same shape of ramped surface 50.

Rather than a wire compression spring bias, as in the female connector 3, the ball cage 49 of the tubular connection part 45 is moved by (in this case three) gas springs 52 which are disposed on the outside the tubular connection part 45, along the longitudinal axis of the tensioner and between the main hydraulic cylinders 39. The gas springs 52 have their moveable rods being attached through slots 54 in the wall of the body 51 to the ball cage 49, so as to bias it, and hence the balls 47 towards the engaged position.

Alongside each gas spring 52, a hydraulic actuator 53 is provided as a release mechanism. Each hydraulic actuator 53 can be energised to act against the gas spring 52, retracting its rod 55, which is connected through the same slot 54 in the wall of the body, so as to disengage the ball cage 49, and hence the balls 47, so as to allow the tensioner 28 to be removed from the connector assembly 1. In normal use, the rod of the hydraulic actuator 53 is simply allowed to be moved back and forth by the motion of the ball cage 49 against the bias of the gas springs 52.

In use, to connect a mooring line to a TLP (e.g. one supporting a wind turbine), a subsea buoy, a subsea wave power generator or a surface wave power generator, the method is essentially the same and will be described with reference to a subsea buoy 6 shown in FIGS. 16 and 17.

The subsea buoy 6 is provided with the necessary number of female connectors 3, by attaching them via hang-off porches 5, supporting the cradles 4, in which the female connectors are pivotably mounted. As shown in FIG. 15, the mounting of the female connector 3 in the cradle 4 allows it to pivot about an angle of up to 10 degrees either side of the normal, and the mounting of the cradle in the hang off porch 5 allows for pivoting at an angle of up to 10 degrees either side of the normal in a direction perpendicular to the axis of the pivot of the female connector 3 in the cradle 4.

A corresponding number of male connectors 2 are provided, each connected to a respective tether 13 via the terminal 12. The opposite end of the tether 13, which may for example be a composite fibre rope, is attached to the seabed in the usual manner.

A guidewire (not shown) is attached to the eye 11 of the male connector 2 and threaded through the bore 7 in the female connector 3 from the bottom to the top. This guidewire is then pulled through the respective female connector 3 for the relevant male connector 2. Known techniques (such as described in WO2012/001406) allow for the amount of tension created by the s buoyancy of the buoy 6 to be kept to a minimum for this initial part of the installation. In this initial part of installation, each male connector 2 is only pulled a short distance through the female connector 3.

As the male connector 2 is pulled a short distance through the female connector 3, the thicker parts of the bar 8 (between the grooves 9) push the balls 17 of the female connector 3 upwards against the spring bias, then outward, into the disengaged position, then, as the next groove 9 reaches each ball 17, the spring 26 biases it downward into engagement. Each male member 2 may be pulled a distance of say 1 metre into the female connector 3, so as to engage for example with the fifth and sixth grooves from the top.

The tethers 13 will typically be at slight angle to buoy 6, and the pivoting of the female connector 3 and the cradle 4 brings the angle of the connectors 2, 3 in line with the mooring line 13, allowing the male connector 2 to be pulled through the female connector 3 in a straight line.

With the buoy 6 at its working buoyancy, the tension of each tether 13 can be adjusted so as to be equal, such that the subsea buoy 6 is flat. To do this, a tensioner 28 is lowered (e.g. by a work wire, guided by an ROV) onto the top of the connector assembly 1 that needs to be tensioned. FIG. 17 shows a tensioner 28 on each connector assembly 1, but a single tensioner could be used to tension one connector assembly 1 then move onto the next.

In order to aid the lowering of the tensioner 28 onto the connector assembly 1, the cage 49 of the tubular connection part 45 of the first part 29 of the tensioner 28 can be retracted by retracting the rod 56 of the hydraulic cylinder 53.

Once the tensioner 28 is in place, engaged with and sitting on top of the female connector 3 (in line with the axis of its bore 7 and hence with the axis of the male connector 2, thanks to the matching frustoconical surfaces 31, 33), the activation of the hydraulic cylinder 53 can be released at which point the gas springs 52 will bias the locking balls 47 into engagement with grooves 9 on the male connector 2.

Then, the tensioner 28 can be activated to adjust the point at which the female connector 3 is connected to the male connector 2 so as to vary the tension applied to the mooring line 13.

In particular, the tensioner 28 can increase the tension applied to the mooring line 13, by supplying hydraulic fluid (via an umbilical) to the three main hydraulic cylinders 39 that sit between the first part 29 and the second part 30, thus extending the rods 40 and moving the first part 29 away from the second part 30 to pull the male connector 2 through the female connector 3, until the female connector 3 is connected to the male connector 2 at a different point, i.e. until the sets of locking members 17 of the female connector 3 engage with different grooves 9 further down the length of the male connector 2.

Figure 10:
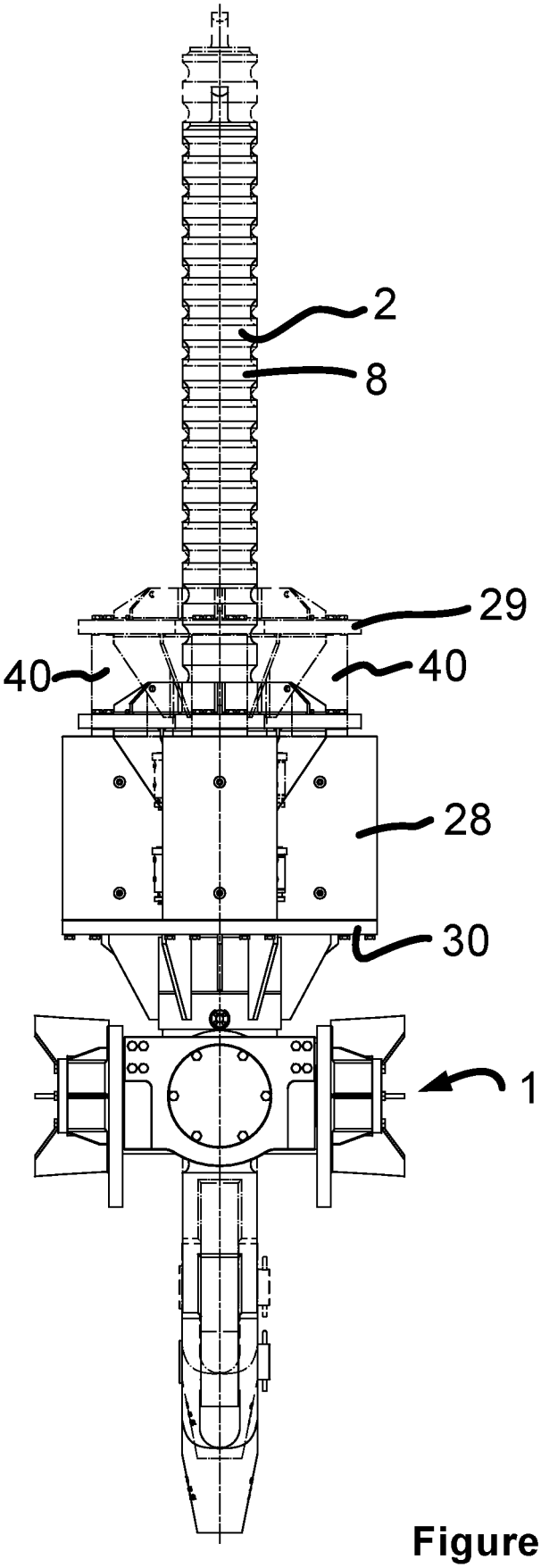
FIG. 10 shows a side view of the mooring connector assembly of FIGS. 1 to 7 together with a tensioner; the tensioner, phantom lines show the male connector and part of the tensioner in a second position.
Figure 11:
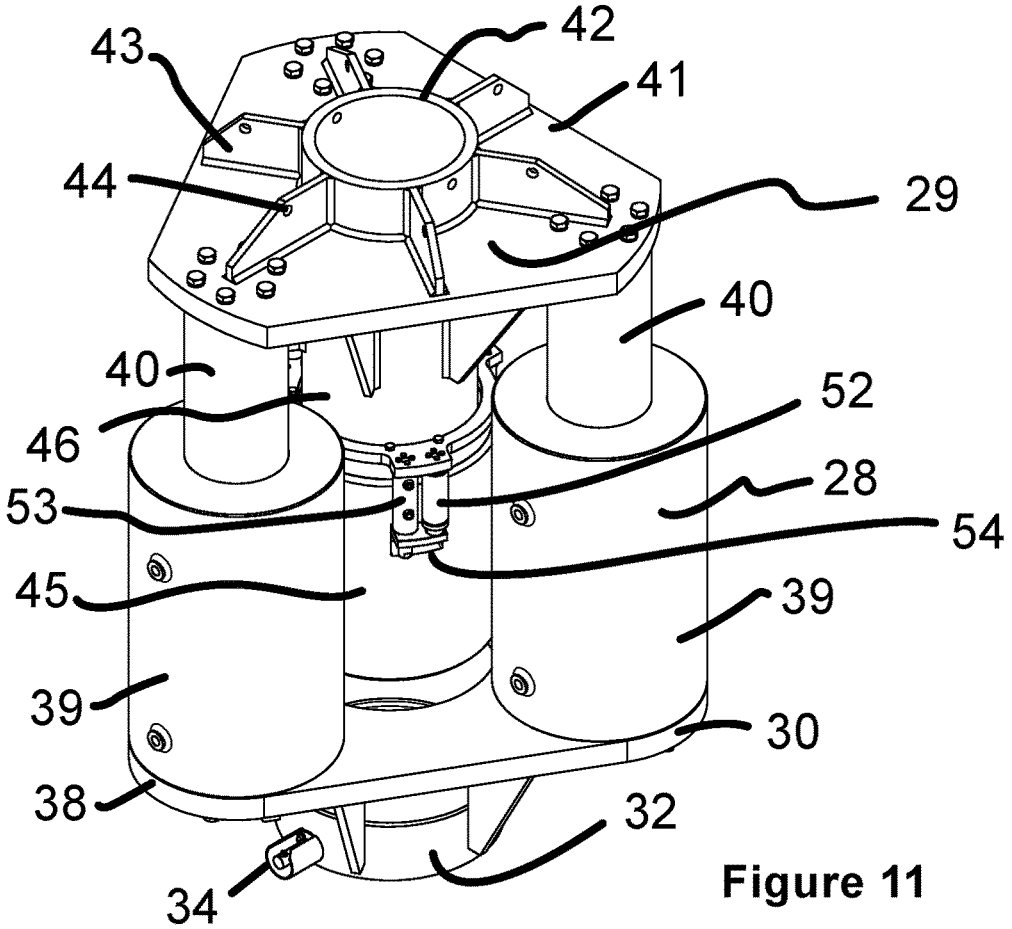
FIG. 11 shows a perspective view of the tensioner of FIG. 10.
Figure 12:
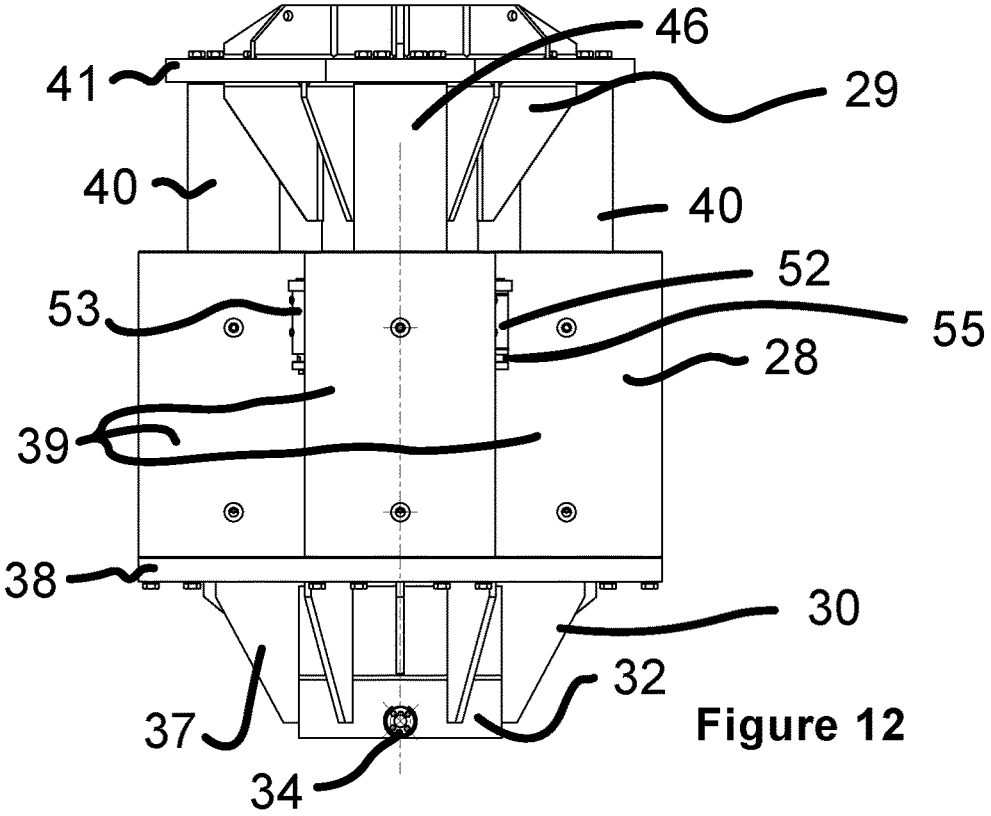
FIG. 12 shows a side view of the tensioner of FIGS. 10 and 11 in a fully stroked position.

As shown (by phantom lines) in FIG. 10, the stroke of the hydraulic cylinders 39 may be more than twice as long as the pitch between the grooves 9, in which case, the male connector 2 may be moved to a point two grooves 9 further through the female connector 3.

Next, the first part 29 is disengaged from grooves 9 of the male connector 2 by reciprocating it back towards the second part 30 (by energising the hydraulic cylinders 39 in the opposite direction). As it is moved down the male connector 2, the balls 49 re-engage with the male connector 2, in grooves 9 further down it, and to further increase the tension, the first part 29 can be reciprocated away from the second part 30 once again, so as to move the male connector 2 relative to the female connector 3 so as to further change the point at which the female connector 3 is connected to the male connector 2 in order to further increase the tension applied to the mooring line 13.

Once the desired tension has been reached, the tensioner 28 can be removed and optionally used to tension another mooring line 13 attached via another connector assembly 1 on the same buoy 6, or retrieved to a vessel for use on another buoy 6 or the like.

To reduce the tension applied to a mooring line 13 connected to a subsea buoy 6 or the like the tensioner 28 can once again be engaged with the connector assembly 1 by seating it on the female connector 3, and engaging the first part with the male connector 2 by allowing the gas springs 52 to cause the balls 47 to engage with the grooves 9. Then, the main cylinders 39 can be energised to move the first part 29 slightly away from the second part 30, which pulls the male connector 2 through the female connector 3 such that the female connector 3 is disengaged from the male connector 2 and its cage 19 has moved upwards into the rebate 35; then, the couplers on the tensioner 28, in the form of the hydraulically actuated rods 58 can be actuated (via fluid from umbilicals) so as to engage with the couplers on the female connector 3 (in the form of bores 57 in the cage 19). This will hold the locking members 17 of the female connector 3 in the disengaged position and tension can be reduced by allowing the male connector 2 to become disengaged from the female connector 3 and letting it pass back out of it.

During normal use, the arrangement of the balls 17 on the ramped surface 20 which has its smaller diameter region towards the first open end at the bottom of the female connector 3 means that if the male connector 2 is pulled (by tension on the tether) towards the first open end (i.e. out of the entrance), and attempts to move the locking members 17, they are pulled more strongly into engagement.

The above embodiment is described by way of example only. Many variations are possible without departing from the scope of the invention as defined in the appended claims.

The invention claimed is:

1. A mooring line connector assembly, the mooring line connector assembly comprising complementary male and female connectors, wherein the male connector is rigid and the female connector is connectable to the male connector at a plurality of points along its length, so as to vary the tension applied to the mooring line, wherein the female connector is pivotally mounted in a cradle and wherein the female connector pivots about an axis of rotation.

2. A mooring line connector assembly according to claim 1 wherein the male connector is provided with a plurality of grooves or recesses along its length for engagement with the female connector;

wherein the female connector comprises a body and one or more locking members for engagement with the grooves or recesses of the male connector which are moveable relative to the body between engaged and disengaged positions; and wherein the one or more locking members are resiliently biased towards the engaged position.

3. A mooring line connector assembly according to claim 2 wherein the one or more locking members comprise locking balls or rollers.

4. A mooring line connector assembly according to claim 3 wherein the locking balls or rollers are provided in one or more cages and wherein the one or more cages are resiliently biased to bias the locking balls or rollers towards the engaged position.

5. A mooring line connector assembly according to claim 4 wherein the one or more cages comprise a coupler for coupling to a tensioner, such that the one or more locking members can be held in the disengaged position.

6. A mooring line connector assembly according to claim 5 wherein the female connector comprises a first open end defining an entrance of a bore into which the male connector is inserted and an opposing second end, and wherein the one or more locking members can move between an engaged position closer to the first open end and a disengaged position closer to the second end.

7. A mooring line connector assembly according to claim 6 wherein the second end of the female connector is shaped for connection to the tensioner.

8. A mooring line connector assembly according to claim 6 wherein the coupler on the one or more cages is arranged at the second end of the female connector, to extend out of the second end of the female connector for engagement with the tensioner.

9. A mooring line connector assembly according to claim 1 wherein the cradle is pivotally mountable to a structure, and wherein the cradle pivots about an axis of rotation.

10. A mooring line connector assembly according to claim 9 wherein the axis of rotation of the female connector relative to the cradle is perpendicular to the axis of rotation of the cradle relative to the structure it is mountable to.

11. A tensioner for adjusting tension on a mooring line connector assembly, comprising: a first part arranged to engage with a rigid male connector of a mooring line connector assembly and a second part arranged to engage with a female connector of a mooring line connector assembly, wherein the first part is reciprocably moveable relative to the second part such that, in operation, the male connector is moveable relative to the female connector to change a point at which the female connector can connect to the male connector to vary tension applied to a mooring line.

12. A tensioner according to claim 11 comprising a plurality of linear actuators for moving the first part relative to the second part so as to move the male connector relative to the female connector to change the point at which the female connector is connected to the male connector.

13. A tensioner according to claim 11 wherein the male connector is provided with a plurality of grooves or recesses along its length and the female connector comprises a body and one or more locking balls or rollers for engagement with the grooves or recesses, wherein the one or more locking balls or rollers are moveable relative to the body between engaged and disengaged positions; wherein the one or more locking balls or rollers are provided in one or more cages and the one or more cages are resiliently biased so as to bias the one or more locking balls or rollers towards the engaged position; wherein the one or more cages comprises a first coupler for coupling to the tensioner; and wherein the second part of the tensioner comprises a second coupler for coupling to the one or more cages of the female connector such that the one or more locking balls or rollers of the female connector can be held in the disengaged position.

14. A tensioner according to claim 11 wherein the first part of the tensioner comprises one or more locking members for engagement with the male connector; the one or more locking members being moveable between engaged and disengaged positions.

15. A tensioner according to claim 14 wherein the one or more locking members comprise one or more locking balls or rollers.

16. A tensioner according to claim 15 wherein one or more resilient biasing members are provided to bias the one or more locking members towards the engaged position.

17. A tensioner according to claim 14 wherein one or more release mechanisms are provided to move the one or more locking members to a disengaged position.

18. A tensioner according to claim 14 wherein the one or more locking members are moveable along one or more ramps in the first part of the tensioner between the disengaged position and the engaged position, and wherein a shape defined by inner edges of the one or more locking members is smaller in the engaged position than the disengaged position.

19. A method comprising using a tensioner to reduce the tension applied to a mooring line connected to a tension leg platform, a subsea buoy, a subsea wave power generator or a surface wave power generator with a connector;

the connector comprising complementary male and female connectors, wherein the male connector is rigid and is provided with a plurality of grooves or recesses along its length and the female connector is connectable to the male connector at a plurality of points along its length; wherein the female connector comprises a body and one or more locking balls or rollers for engagement with the grooves or recesses, wherein the one or more locking balls or rollers are moveable relative to the body between engaged and disengaged positions; wherein the one or more locking balls or rollers are provided in one or more cages; wherein the one or more cages are resiliently biased to bias the one or more locking balls or rollers towards the engaged position; and wherein the one or more cages comprise a coupler for coupling to the tensioner;

the tensioner having a first part arranged to engage with the male connector and a second part arranged to engage with the female connector and wherein the first part is reciprocally moveable relative to the second part so as to move the male connector relative to the female connector to change the point at which the female connector is connected to the male;

the method comprising seating the tensioner on the connector, engaging the first part with the male connector and the second part with the female connector, pulling the male connector through the female connector such that the female connector is disengaged from the male connector and coupling the coupler to hold the one or more locking balls or rollers of the female connector in the disengaged position, then allowing the male connector to become disengaged from the female connector.

* * * * *